US011421564B2

(12) United States Patent
Kato

(10) Patent No.: US 11,421,564 B2
(45) Date of Patent: Aug. 23, 2022

(54) ELECTRIC VARIABLE CAM TIMING CONTROL DEVICE

(71) Applicant: DENSO CORPORATION, Kariya (JP)

(72) Inventor: Yoshiki Kato, Kariya (JP)

(73) Assignee: DENSO CORPORATION, Kariya (JP)

( * ) Notice: Subject to any disclaimer, the term of this patent is extended or adjusted under 35 U.S.C. 154(b) by 115 days.

(21) Appl. No.: 16/854,955

(22) Filed: Apr. 22, 2020

(65) Prior Publication Data

US 2020/0370451 A1 Nov. 26, 2020

(30) Foreign Application Priority Data

May 23, 2019 (JP) ..... JP2019-096781

(51) Int. Cl.
*F01L 9/20* (2021.01)
*F01L 9/30* (2021.01)

(52) U.S. Cl.
CPC . *F01L 9/20* (2021.01); *F01L 9/30* (2021.01); *F01L 2201/00* (2013.01); *F01L 2800/01* (2013.01); *F01L 2800/03* (2013.01); *F01L 2800/14* (2013.01)

(58) Field of Classification Search
CPC . F01L 9/20; F01L 9/30; F01L 2201/00; F01L 2800/01; F01L 2800/14; F01L 2800/03; F01L 2800/00; F01L 2820/041; F01L 2820/042; F01L 2820/032; F01L 1/352; F02D 2041/2027; F02D 2041/2058; F02D 2041/001; F02D 41/042
See application file for complete search history.

(56) References Cited

U.S. PATENT DOCUMENTS 8,939,113 B2 * 1/2015 Kanda ..... F01L 1/352 123/41.2
2007/0096672 A1 5/2007 Endo et al.
2009/0160385 A1 6/2009 Ishihara
2010/0181951 A1 7/2010 Noie et al.

FOREIGN PATENT DOCUMENTS

JP 2002-281789 A 9/2002
JP 2006-304477 A 11/2006
JP 2008-072844 A 3/2008
JP 2008-086111 A 4/2008
JP 2009-044913 A 2/2009
JP 2009-108705 A 5/2009
JP 2009-159810 A 7/2009

* cited by examiner

*Primary Examiner* — Jacob M Amick
*Assistant Examiner* — Charles J Brauch
(74) *Attorney, Agent, or Firm* — Posz Law Group, PLC

(57) ABSTRACT

When an EDU determines that a motor is in a control unstable state where the motor cannot be controlled to a target rotation speed due to a drive voltage output duty value being smaller than a threshold value, the EDU performs a control point shifting operation to shift a control point between a first control point, which is in the control unstable state, and a second control point, which is a control stable state outside the control unstable state. Thus, even when the motor is in a stepping rotation state, it is possible to control the target rotation speed regardless of influence of a cogging torque, and appropriately control the cam phase of the intake camshaft to a target phase when the engine is stopped.

9 Claims, 9 Drawing Sheets

ELECTRIC VARIABLE CAM TIMING CONTROL DEVICE

CROSS REFERENCE TO RELATED APPLICATION

The present application claims the benefit of priority from Japanese Patent Application No. 2019-096781 filed on May 23, 2019. The entire disclosures of the above application is incorporated herein by reference.

FIELD

The present invention relates to an electric variable cam timing control device.

BACKGROUND

A conventional electric variable cam timing device (VCT) of an internal combustion engine is configured to control a cam phase of a camshaft to a target phase with high response characteristics by controlling a rotation speed of an electric motor even under low temperature environment, thereby improving output power, fuel economy and exhaust emissions of the engine.

In the conventional electric VCT, the rotation speed of the motor is controlled to set the cam phase to an optimum phase for the next start of the engine during a period from stopping of the engine to stopping of the camshaft.

The motor for the electric VCT is designed intentionally to have a larger cogging torque to maintain the cam phase during stopping of the engine.

SUMMARY

According to the present disclosure, an electric variable cam timing control device is provided for controlling a cam phase of a cam shaft of an engine to a target phase by controlling a motor to a target rotation speed. The electric variable cam timing control device comprises a rotational torque increase unit configured to check whether the motor is in a control unstable state in which the motor is disabled to be controlled to the target rotation speed, and shift a control point when the motor is in the control unstable state.

DETAILED DESCRIPTION OF THE EMBODIMENT

Figure 1:
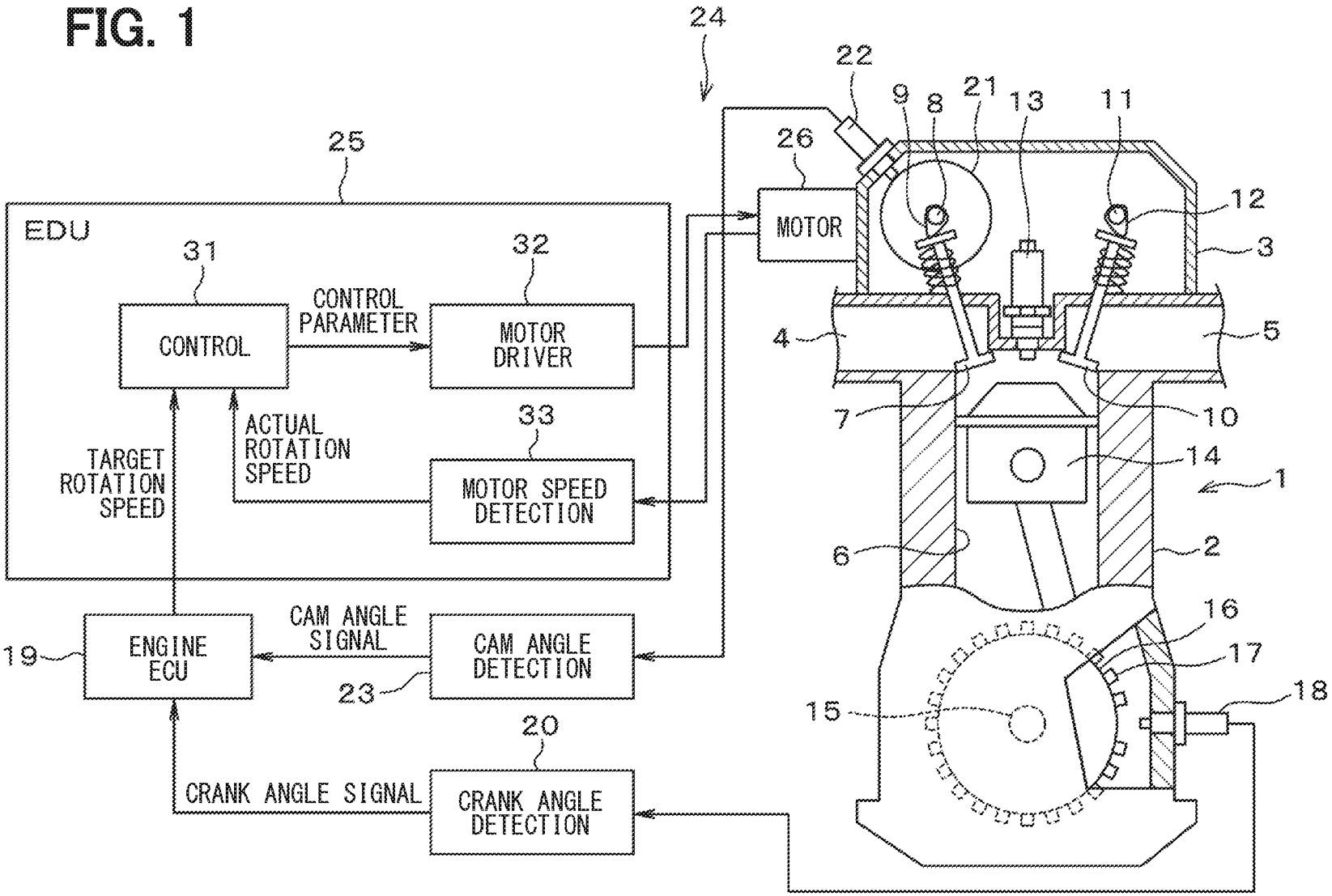
FIG. 1 is a block diagram showing an electric VCT system according to a first embodiment.

Hereinafter, multiple embodiments will be described with reference to the drawings. In the multiple embodiments, functionally and/or structurally same or similar portions are designated with the same reference numerals for simplicity of description.

First Embodiment

A first embodiment will be described with reference to FIG. 1 to FIG. 7.

As shown in FIG. 1, an engine body 1 of an internal combustion engine includes a cylinder block 2 and a cylinder head 3 mounted on the cylinder block 2. An intake passage 4 and an exhaust passage 5 are formed in the cylinder head 3. These passages 4 and 5 communicate with an inside chamber of a cylinder 6. An intake valve 7 is provided in an intake port that communicates the intake passage 4 and the cylinder 6. The intake valve 7 is provided to normally close the intake port between the intake passage 4 and the cylinder 6 and open the intake port by being pressed by an intake cam 9 integrated with an intake camshaft 8.

An exhaust valve 10 is provided in an exhaust port that communicates the exhaust passage 5 and the cylinder 6. The exhaust valve 10 is provided to normally close the exhaust port and open the exhaust port by being pressed by an exhaust cam 12 integrated with an exhaust camshaft 11.

An ignition plug 13 is provided in the cylinder head 3 to ignite vaporized fuel compressed by a piston 14 in the cylinder 6.

When the vaporized fuel compressed by the piston 14 is ignited, the vaporized fuel explodes and expands, so that the piston 14 descends and rotates a crankshaft 15 provided in the cylinder block 2.

A crank rotor 16 is attached to the crankshaft 15. A crank angle sensor 18 is provided so as to face a tooth portion 17 provided on the outer periphery of the crank rotor 16, and outputs a pulse signal indicating a predetermined amount of angular rotation of the crank rotor 16. A crank angle detection circuit 20 is connected to the crank angle sensor 18 and configured to output a crank angle signal indicating a crank angle to an engine ECU 19 based on the pulse signal from the crank angle sensor 18.

A cam rotor 21 is mounted on the intake camshaft 8. A cam angle sensor 22 is attached to the cylinder head 3 to face the outer periphery of the cam rotor 21. The cam angle sensor 22 outputs a pulse signal indicating a predetermined amount of angular rotation of the cam rotor 21. A cam angle detection circuit 23 is connected to the cam angle sensor 22 and configured to output a cam angle signal indicating an intake cam angle to the engine ECU 19 based on a pulse signal from the cam angle sensor 22.

The rotation of the crankshaft 15 is transmitted to the intake camshaft 8 and the exhaust camshaft 11 by a timing chain (not shown), so that the intake camshaft 8 and the exhaust camshaft 11 make one rotation while the crankshaft 15 makes two rotations.

An electric variable cam timing control device 24 is attached to an end of the intake camshaft 8 and hereinafter referred to simply as an electric VCT 24. The electric VCT 24 is configured to transmit the rotation of the crankshaft 15 to the intake camshaft 8 while electrically controlling a cam phase of the intake camshaft 8 relative to the rotation of the crankshaft 15.

Figure 2:
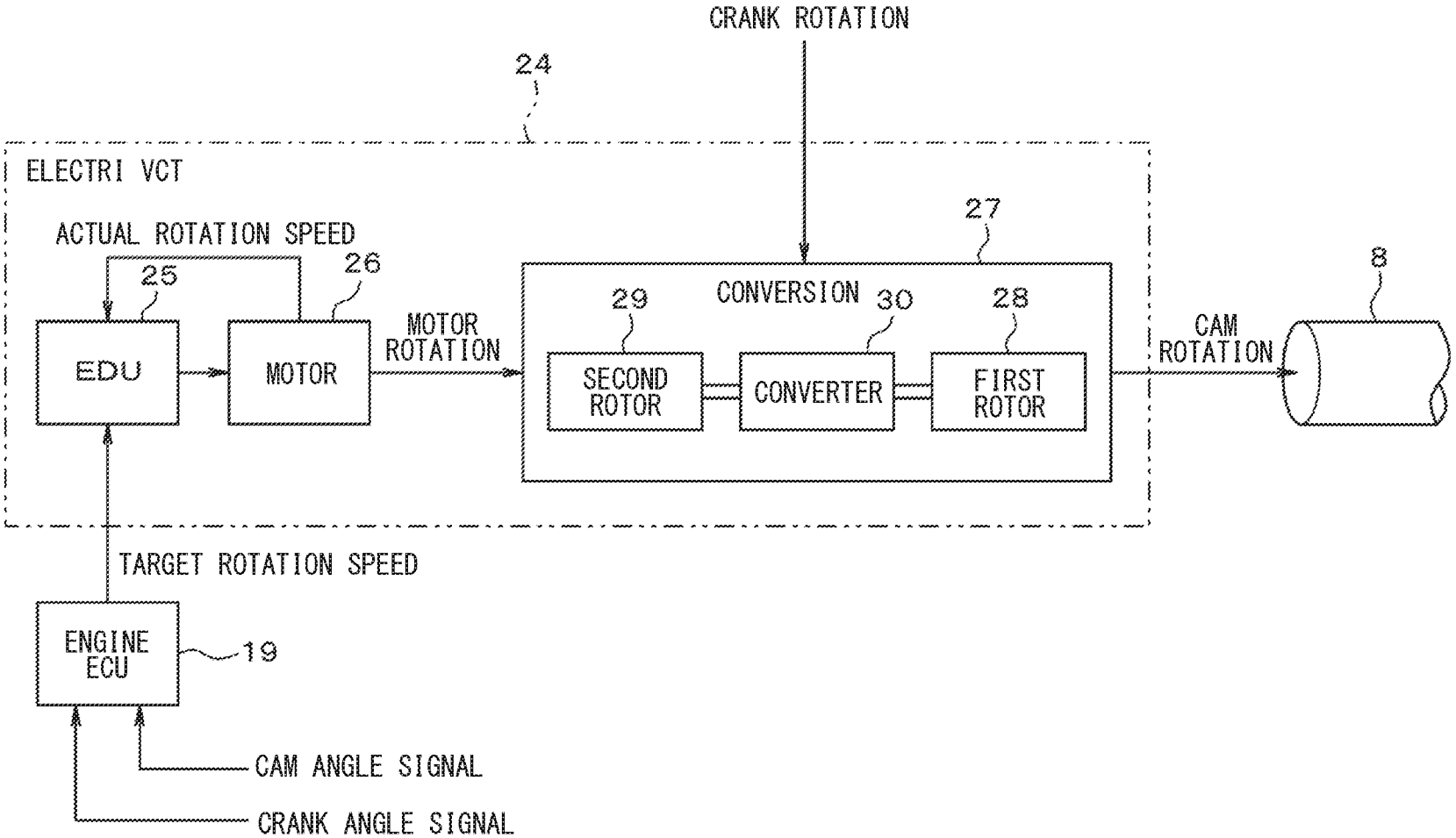
FIG. 2 is a block diagram showing a configuration of an electric VCT.

The electric VCT 24 includes an EDU (electric drive unit) 25, which is provided as a control device, a motor 26, and a converter 27 as shown in FIG. 2. The converter 27 includes a first rotor body 28, a second rotor body 29, and a conversion mechanism 30. The first rotor body 28 is connected to the crankshaft 15 via a timing chain, and makes one rotation while the crankshaft 15 makes two rotations. The second rotor body 29 is connected to the motor 26 via a speed reduction device, and makes one rotation while the motor 26 makes, for example, one hundred rotations.

The conversion mechanism 30 generates a cam phase for the intake camshaft 8 based on a difference in rotation speeds (numbers of rotations) between the first rotor body 28 and the second rotor body 29. The rotation of the first rotor body 28 is transmitted to the intake camshaft 8 with the cam phase generated by the conversion mechanism 30. The cam phase indicates a phase difference between the first rotor body 28 and the second rotor body 29.

When the rotation speeds of the first rotor body 28 and the second rotor body 29 match, no cam phase is generated, and the rotation of the first rotor body 28 is transmitted to the intake camshaft 8 in a phase maintained state. When the rotation speed of the second rotor body 29 is larger than that of the first rotor body 28, a cam phase is generated. In this case, the rotation of the first rotor body 28 is transmitted to the intake camshaft 8 in a phase advanced state. When the rotation speed of the second rotor body 29 is lower than that of the first rotor body 28, a cam phase is generated. In this case, the rotation of the first rotor body 28 is transmitted to the intake camshaft 8 in a phase retarded state.

That is, the following relationship is established.

Phase maintained state: rotation speed of first rotor body 28=rotation speed of second rotor body 29

Advanced phase state: rotation speed of first rotor body 28<rotation speed of second rotor body 29

Retarded phase state: rotation speed of first rotor body 28>rotation speed of second rotor body 29.

Since the configuration of the electric VCT 24 is known well in the art, no more detailed description is made.

An engine ECU (electronic control unit) 19 is configured to perform fuel injection control and ignition control of the ignition plug 13 in accordance with engine operating states detected by various sensors such as an intake pressure sensor, a cooling water temperature sensor and a throttle sensor (not shown).

Further, the engine ECU 19 is configured to detect a phase difference between the two by inputting the crank angle signal indicating the crank angle and the cam angle signal indicating the intake cam angle, calculate a target rotation speed of the motor 26 based on a detected phase difference, and output a calculated target rotation speed to the EDU 25.

The EDU 25 is configured mainly by a motor drive IC (not shown) to perform PWM control of the motor 26. The EDU 25 may alternatively be configured by a microcomputer to perform the PWM control of the motor 26. The motor 26 is a three-phase brushless synchronous motor having built-in permanent magnets. The motor drive IC has a function of a control unit 31, which operates as a rotational torque increase unit and is realized by a program stored in a non-transitive tangible memory medium, and has a motor drive unit 32 and a motor rotation speed detection unit 33.

The control unit 31 is configured to output an output duty value of a drive voltage to a motor drive unit 32 as a control parameter so that the rotation speed of the motor 26 becomes the target rotation speed. The motor drive unit 32 is configured to drive the motor 26 based on the output duty value provided from the control unit 31. The motor rotation speed detection unit 33 is configured to detect an actual rotation speed of the motor 26 and feed a detected rotation speed back to the control unit 31.

Figure 3:
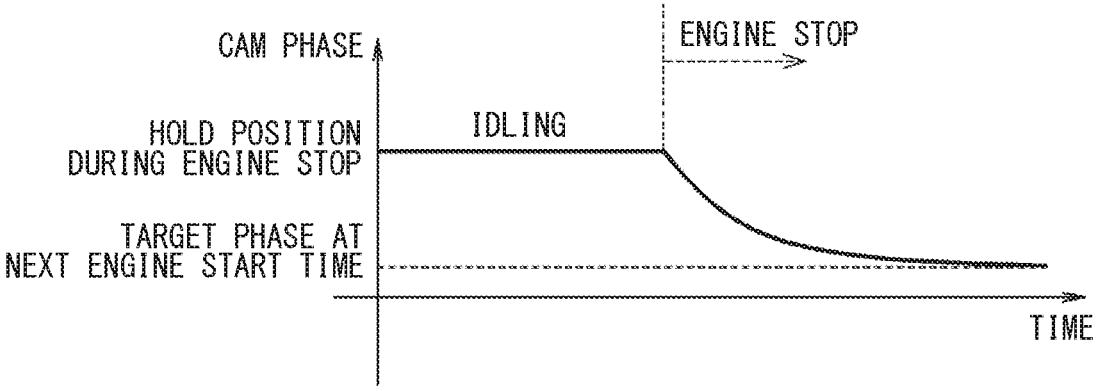
FIG. 3 is a time chart showing a change in a cam phase after stopping of an engine.

The electric VCT 24 is so configured that, as shown in FIG. 3, the motor 26 is controlled to a target rotation speed in a period from stopping of the engine to stopping of rotation of the intake camshaft 8 when the engine is stopped by stopping fuel injection and ignition by turning off the ignition switch. Thus, at the time of stopping the engine, the cam phase of the intake camshaft 8 is controlled to the target phase. This is to improve the starting characteristics of the next starting operation of the engine by controlling the cam phase to an optimum value when the engine is stopped.

Figure 4:
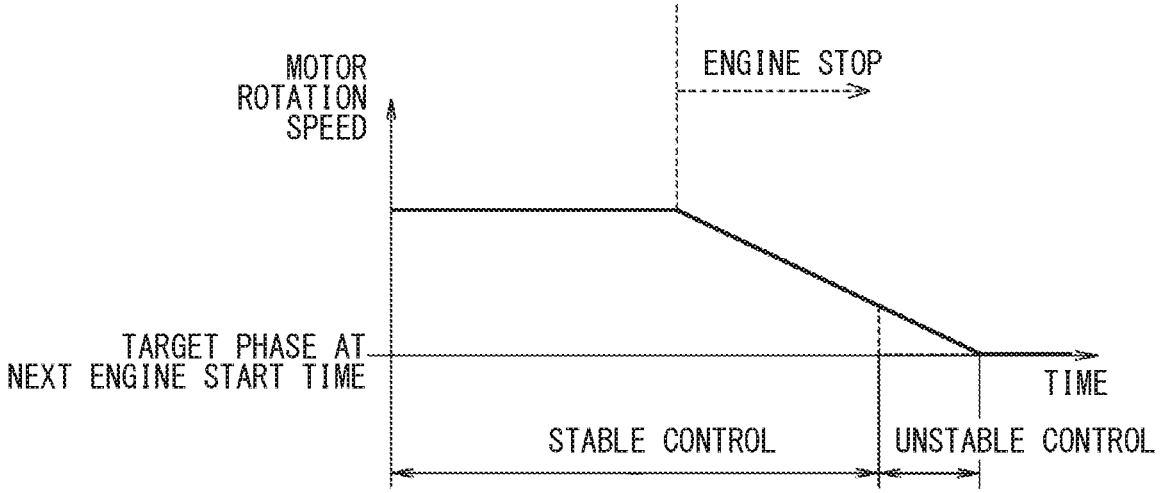
FIG. 4 is a time chart showing a change in a motor rotation speed after stopping of the engine.
Figure 5:
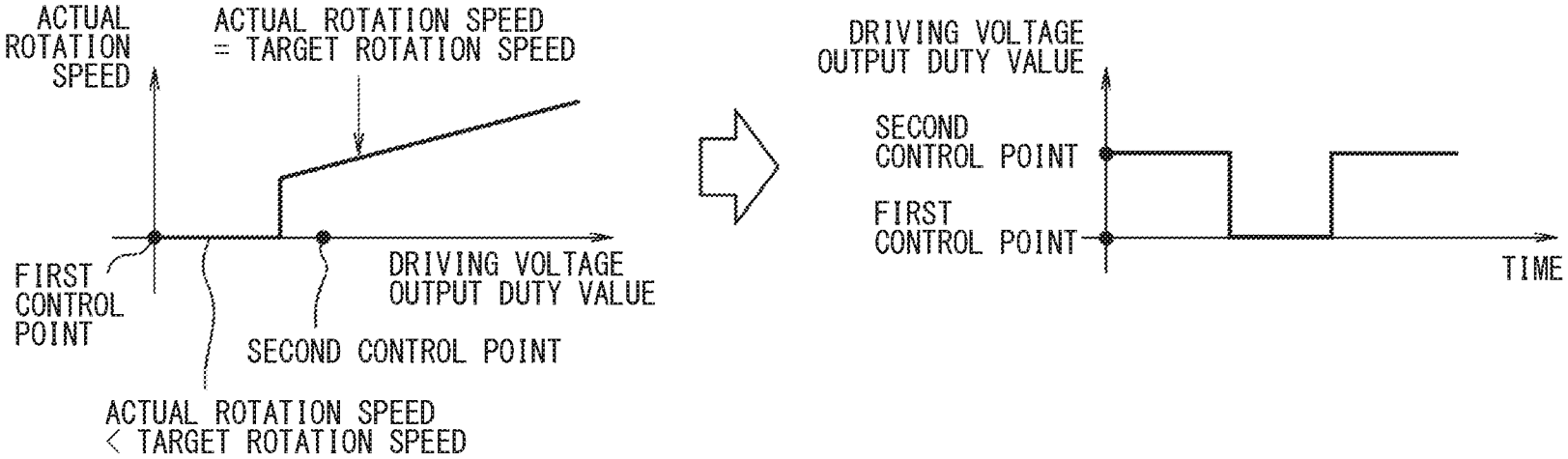
FIG. 5 is a time chart schematically showing a control point shifting operation.

The electric VCT 24 is designed intentionally so that a cogging torque is increased in order to improve the retention of the cam phase while the engine is stopped. For this reason, it is not possible in some cases for a rotational torque of the motor 26 to exceed the increased cogging torque at the time of stepping rotation state of the motor 26. In such a case, as shown in FIG. 4, the controllability of the motor 26 may be degraded and the motor 26 may be in a control unstable state in which the motor 26 cannot be controlled to the target rotation speed.

When the engine is stopped in such a control unstable state, the cam phase of the intake camshaft 8 may deviate from the target phase, and the starting characteristics of the next engine starting may be deteriorated.

Under such circumstances, a rotational torque increase control is performed by increasing a current supplied to the motor 26 in the control unstable state in which the motor 26 cannot be controlled to the target rotation speed. That is, in the configuration in which the rotation speed of the motor 26 is controlled by controlling an output duty value of the drive voltage, a control point shifting is performed between a first control point, where the output duty value of the drive voltage is located in the control unstable state, and a second control point, where the output duty value of the drive voltage is located in the control stable state which left from the control unstable state.

In the present embodiment, the control point shifting is performed by setting the first control point to 0 V and the second control point to a drive voltage that is sufficiently higher than a peak of the cogging torque of the motor 26. In this case, unlike a stepping motor, the motor 26 is controlled not by the number of pulses but by the output duty value of the drive voltage in the stepping rotation state of the motor 26, However, in case that such a shifting operation is performed during normal rotation time, a fluctuation width of the rotation speed increases and power consumption increases. For this reason, the shifting operation is performed only in the stepping rotation state of the motor 26.

The stepping operation described above may be performed when the motor 26 rotates not only in the forward direction but also in the reverse direction. That is, when the cam phase of the intake camshaft 8 is controlled to the retard side at the time of the stepping rotation of the motor 26, it is possible to shorten the time required to attain the target rotation speed by performing the control in the reverse rotation state rather than by performing the control in the forward rotation state so as to reduce the target rotation speed of the motor 26.

Specifically, the EDU 25 is configured to control the output duty value of the drive voltage of the motor 26 as follows.

Figure 7:
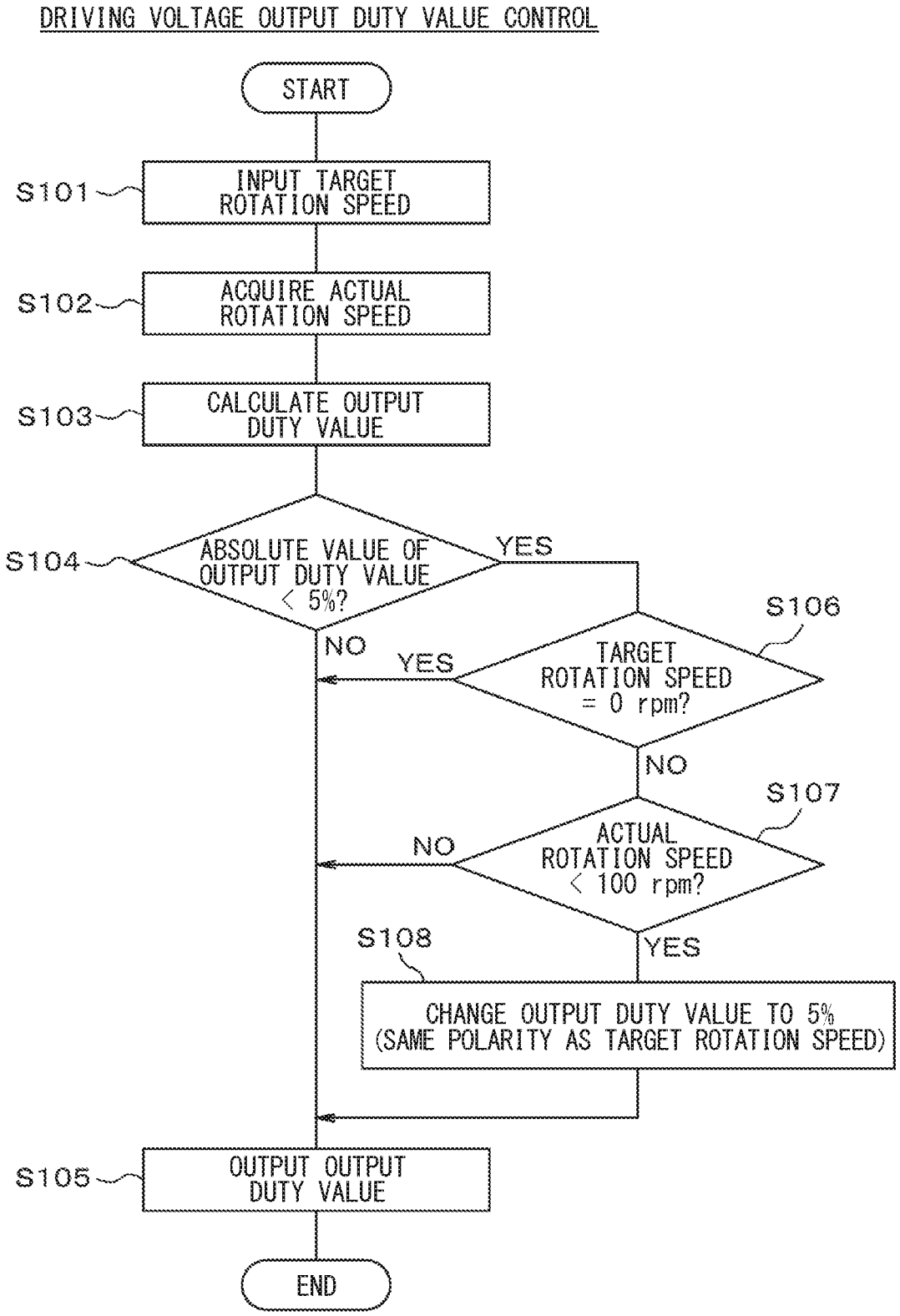
FIG. 7 is a flowchart showing output duty value control of a drive voltage.

As shown in FIG. 7, in the output duty value control of the drive voltage, the target rotation speed of the motor 26 corresponding to a present operating state is input from a data map (not shown) (S101), the actual rotation speed of the motor 26 is acquired (S102), and the output duty value corresponding to the target rotation speed is calculated (S103) based on the target rotation speed and the actual rotation speed. In this case, the output duty value when the motor 26 rotates forward is made positive, and the output duty value when the motor 26 rotates reversely is made negative.

Next, it is checked whether an absolute value of the output duty value is smaller than a predetermined threshold value, for example, 5% (S104). The threshold value of 5% is set according to the target rotation speed, and is set to a larger value as the target rotation speed is larger. In the present embodiment, for simplicity of description, the threshold value is assumed to be fixed to 5% regardless of the target rotation speed.

In case the absolute value of the output duty value is 5% or more (S104: NO), the output duty value calculated in step S103 is output to the motor drive unit 32 as it is (S105). The motor drive unit 32 rotationally drives the motor 26 by pulse-width modulation (PWM) control based on the output duty value provided from the control unit 31. Since the motor rotation speed detection unit 33 detects the actual rotation speed of the motor 26 and feeds it back to the control unit 31, the control unit 31 performs feedback control so that the actual rotation speed of the motor 26 becomes the target rotation speed.

As described above, since the cam phase of the intake camshaft 8 is controlled to the target phase, it is possible to improve the output power and fuel efficiency and reduce the exhaust emission of the engine.

In case the absolute value of the output duty value is smaller than 5% (S104: YES), it is highly likely that the control becomes unstable. Therefore, it is checked whether the control has become unstable as follows.

That is, after confirming that the target rotation speed is not 0 rpm (S106: YES), that is, the rotation of the motor 26 is to be controlled, it is checked whether the actual rotational speed of the motor 26 has become the stepping rotation state of, for example, smaller than 100 rpm (S107). In case it is in the stepping rotation state (S107: YES), it is determined that the control is in the unstable state.

As described above, it is possible to determine that the rotational speed of the motor 26 is in the control unstable state in which the rotation speed of the motor 26 is affected by the cogging torque.

During normal engine control, the output duty value may become smaller than 5% (S104: YES). In such a case, the engine rotates at or above the idling rotation speed which is about 600 rpm, for example, and the actual rotation speed of the motor 26 is not in the stepping rotation state smaller than 100 rpm (S107: NO). The output duty value is output as it is (S105).

When a user stops the vehicle and then turns off the ignition switch, the engine stops, but the crankshaft 15 continues to rotate by inertia for a short time and then finally stops. At this time, the control unit 31 continues to control the cam phase of the intake camshaft 8 to be the target phase until the crankshaft 15 stops. In this case, the rotation speed of the crankshaft 15 is rapidly reduced by stopping the engine. Therefore, by reducing the output duty value accordingly, the target rotation speed of the motor 26 is adjusted to be smaller so that the cam phase of the intake camshaft 8 becomes the target phase.

If the target rotation speed of the motor 26 is further reduced to be smaller than 100 rpm (S107: YES), it is determined that the control has become unstable, and the output duty value of the drive voltage is changed to 5% to increase the output duty value (S108). The polarity in this case is the same as the target rotation speed.

Figure 6:
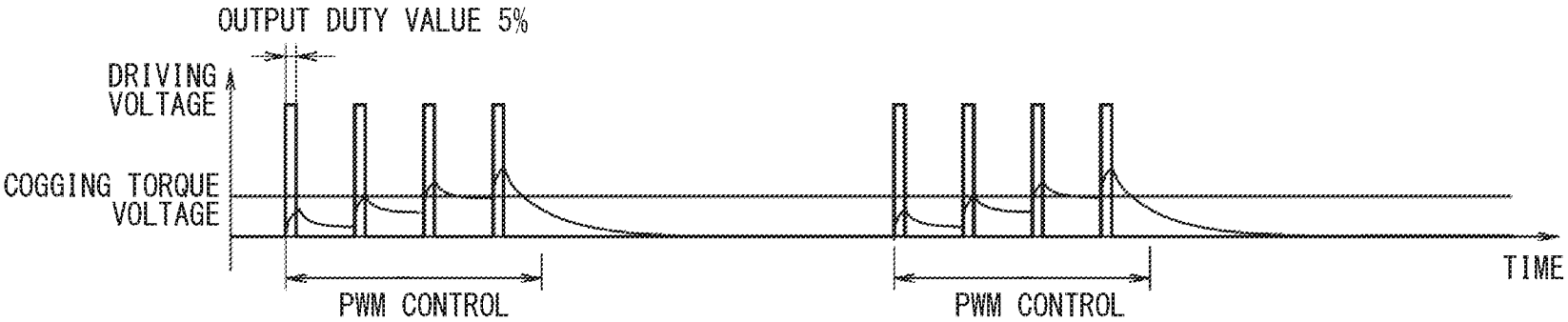
FIG. 6 is a time chart showing a drive voltage at the time of the control point shifting operation.

By the above operation, as shown in FIG. 6, the drive current to the motor 26 increases, and the rotational torque of the motor 26 exceeds the cogging torque accordingly. Thus it is possible to control the motor 26 to attain the target rotation speed regardless of the influence of the cogging torque.

According to the embodiment described above, the following effects can be achieved.

In case the EDU 25 determines that the motor 26 is in the control unstable state in which the motor 26 cannot be controlled to the target rotation speed because the drive voltage output duty value is smaller than the threshold value, the EDU 25 performs the control point shifting operation for shifting the control point between the first control point, at which the motor 26 enters the control unstable state, and the second control point, at which the motor 26 leaves the control unstable state and enters the control stable state, thereby increasing the rotational torque of the motor 26. As a result, even in case that the motor 26 is in the stepping rotation state, it is possible to control the motor 26 to attain the target rotation speed regardless of the influence of the cogging torque, so that the cam phase of the intake camshaft 8 in the engine stop state can be appropriately controlled to the target phase.

It is determined that the control is in the unstable state when the rotation speed of the motor 26 is less than the predetermined rotation speed, for example, 100 rpm, and hence it is possible to determine reliably the control unstable state.

Since the control unstable state is determined on condition that the output duty value of the drive voltage to the motor 26 is smaller than 5%, the control unit 31 determines the control unstable state only when the possibility of the control unstable state is high. Thus, processing load on the control unit 31 can be reduced.

Modified Embodiment

Figure 8:
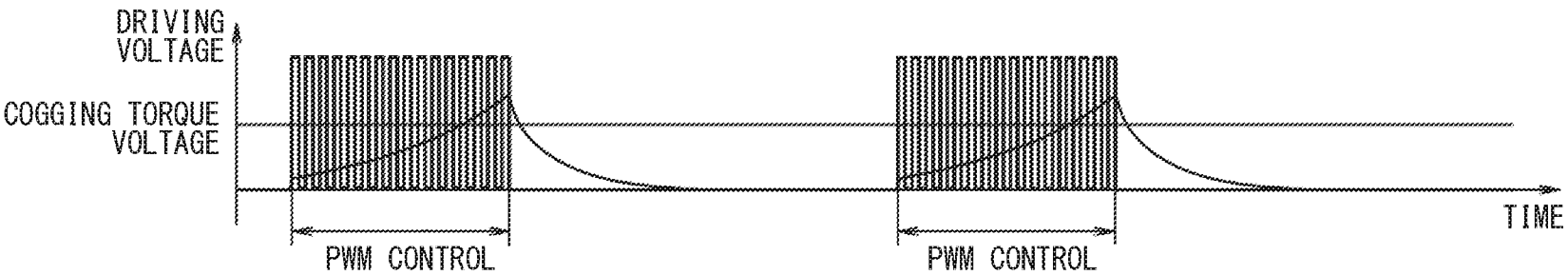
FIG. 8 is a time chart showing a drive voltage in a modified embodiment.

A modified embodiment of the first embodiment will be described with reference to FIG. 8. This modified embodiment is characterized in that a target current value of the phase current of the motor 26 is increased by shortening the output interval of the drive voltage during the PWM control period, that is, by increasing a frequency of a PWM signal.

The EDU 25 is configured to shorten the drive voltage output interval during the PWM control period, when the EDU 25 determines that the motor 26 is in the control unstable state in which the motor 26 cannot be controlled to the target rotation speed because the output interval of the drive voltage is larger than a predetermined threshold value. As a result, the phase current can be increased as shown in FIG. 8, so that the motor 26 is controlled to the target rotation speed regardless of the influence of the cogging torque even in the stepping rotation state of the motor 26 as in the first embodiment. Thus, the cam phase of the intake camshaft 8 can be appropriately controlled to the target phase when the engine is stopped.

Second Embodiment

A second embodiment will be described with reference to FIG. 9 and FIG. 10. The second embodiment is characterized in that an amplitude of a phase current of the motor 26 is directly increased in place of the PWM control.

Figure 9:
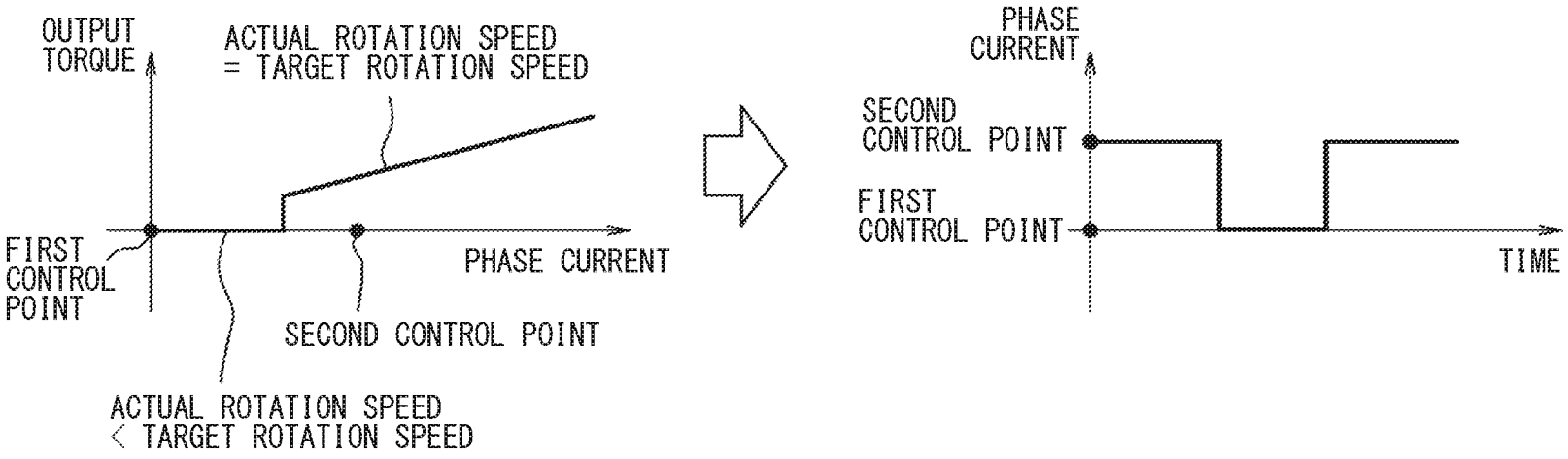
FIG. 9 is a time chart schematically showing a control point shifting operation in a second embodiment.

In case the control becomes unstable in the configuration in which the rotation speed of the motor 26 is controlled by controlling the current value of the phase current of the motor 26, the control point shifting operation is performed between the first control point located in the control unstable state and the second control point located in the control stable state, which left the unstable control state, as shown in FIG. 9.

Figure 10:
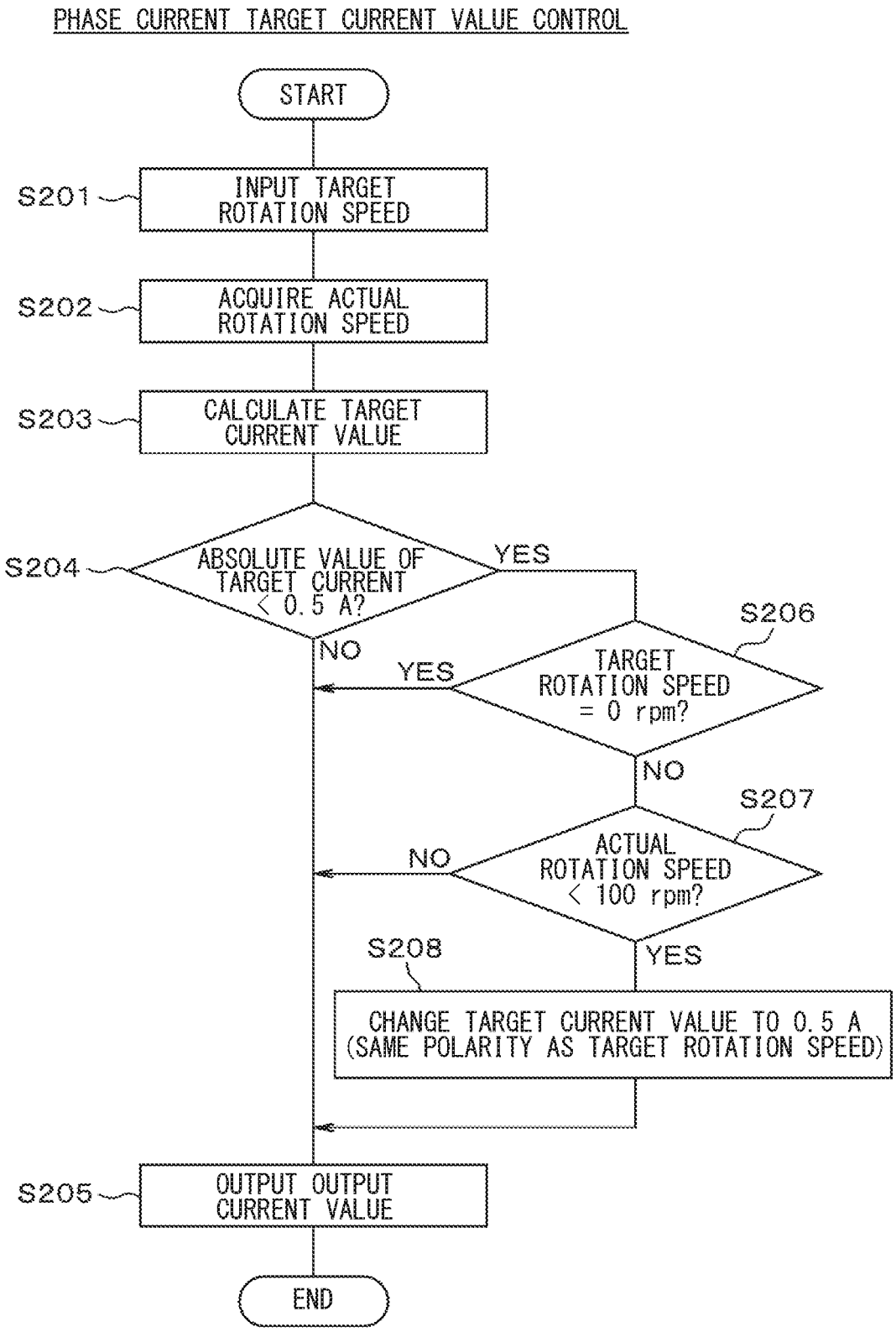
FIG. 10 is a flowchart showing target current value control of a phase current.

Specifically, the EDU 25 is configured to perform processing shown in FIG. 10. The EDU 25 calculates a target current value based on the target rotation speed and the actual rotation speed (S201 to S203), and checks whether an absolute value of the target current value is smaller than a predetermined current threshold value, for example, 0.5 A (S204). If the absolute value of the target current value is 0.5 A or more (S204: NO), the target current value is output to the motor drive unit 32 as it is (S205).

If the absolute value of the target current value is smaller than 0.5 A (S204: YES), after confirming that the target rotation speed of the motor 26 is not 0 rpm (S206: NO), it is checked whether the actual rotation speed is smaller than the predetermined rotation speed, for example, 100 rpm (S207). If the actual rotation speed of the motor 26 is smaller than 100 rpm following the engine stop (S207: YES), it is determined that the control is in the unstable state, and the target current value is changed to 0.5 A (S208). The polarity in this case is the same as the target rotation speed. As a result, the rotational torque of the motor 26 exceeds the cogging torque, so that the motor 26 can be controlled to the target rotation speed regardless of the influence of the cogging torque.

According to the present embodiment, in the configuration in which the motor 26 is controlled by controlling the amplitude of the phase current, the target current value is increased when it is determined that the motor 26 is in the control unstable state in which the motor 26 cannot be controlled to the target rotation speed. As a result, even when the motor 26 is in the stepping rotation state, it is possible to control the target rotation speed irrespective of the influence of the cogging torque, and the cam phase of the intake camshaft 8 in the engine stopped state can be appropriately controlled to the target phase.

Other Embodiment

In the above embodiments, when the execution time period of the control point shifting operation that changes between the first control point and the second control point reaches a predetermined threshold time period value, the control point shifting operation may be stopped. This is to prevent a situation in which the cam phase of the intake camshaft 8 cannot be controlled to the target phase for a long time period even if the motor 26 is continuously controlled to the target rotation speed.

The electric VCT 24 may be provided on the exhaust camshaft 11 or may be provided only on the exhaust camshaft 11.

The electric VCT 24 may be applied to a diesel engine.

Although the present disclosure has been made in accordance with multiple embodiments, it is understood that the present disclosure is not limited to such embodiments or structures. The present disclosure encompasses various modifications and variations within the scope of equivalents. In addition, various combinations and forms, and further, other combinations and forms including only one element, or more or less than these elements are also within the sprit and the scope of the present disclosure.

What is claimed is:

1. An electric variable cam timing control device for controlling a cam phase of a cam shaft of an engine to a target phase by controlling a motor to a target rotation speed, the electric variable cam timing control device comprising a rotational torque increase unit configured to execute processing of:

checking whether the motor is in a control unstable state in which the motor is disabled to be controlled to the target rotation speed; and performing, when the motor is determined to be in the control unstable state, a control point shifting operation for shifting a control point between a first control point and a second control point to increase a rotational torque of the motor, the first control point being a point at which the motor is in the control unstable state, and the second control point being a point at which the motor is in a control stable state outside the control unstable state wherein:

the rotational torque increase unit determines that the motor is in the control unstable state when a rotation speed of the motor is smaller than a predetermined threshold value, and the rotational torque increase unit executes the processing of checking on condition that a control parameter used for controlling the motor is smaller than a predetermined threshold value.

2. The electric variable cam timing control device according to claim 1, wherein:

the control parameter is an output duty value of a drive voltage at time of PWM control; and the rotational torque increase unit executes the control point shifting operation by increasing the output duty value when the output duty value is smaller than the predetermined threshold value.

3. The electric variable cam timing control device according to claim 1, wherein:

the control parameter is an output interval of outputting a drive voltage at time of PWM control; and the rotational torque increase unit executes the control point shifting operation by decreasing the output interval when the output interval is larger than the predetermined threshold value.

4. The electric variable cam timing control device according to claim 1, wherein:

the control parameter is a target current value at time of current value control; and the rotational torque increase unit executes the control point shifting operation by increasing the target current value when the target current value is smaller than the predetermined threshold value.

5. The electric variable cam timing control device according to claim 1, wherein:

the predetermined threshold value is set variably with the control parameter.

6. The electric variable cam timing control device according to claim 1, wherein:

the rotational torque increase unit stops the control point shifting operation when the shifting operation is performed in succession for a predetermined period.

7. The electric variable cam timing control device according to claim 1, wherein:

the electric variable cam timing device includes a first rotor body rotatable by a crankshaft of an engine, a second rotor body rotatable by the motor, and a conversion mechanism for generating a cam phase relative to the camshaft in accordance with a difference between rotations of the first rotor body and the second rotor body, the conversion mechanism transmitting the rotation of the crankshaft to the camshaft with the cam phase.

8. The electric variable cam timing control device according to claim 1, wherein:

the rotational torque increase unit executes the processing of checking and performing during a period in which the crankshaft continues to rotate after stopping fuel injection and ignition in the engine.

9. An electric variable cam timing control device for controlling a cam phase of a cam shaft of an engine to a target phase by controlling a motor to a target rotation speed, the electric variable cam timing control device comprising:

a motor rotation speed detection unit configured to detect an actual rotation speed of the motor; and a control unit configured to control the motor so that the actual rotation speed of the motor attains a target rotation speed during a period following stopping of fuel supply, wherein the control unit is configured to execute processing of:

calculating a control value of the motor based on a speed difference between the target rotation speed and the actual rotation speed;

checking whether the control value of the motor is smaller than a predetermined value;

checking whether the target rotation speed of the motor is substantially zero;

checking whether the actual rotation speed is smaller than a predetermined rotation speed; and changing the control value of the motor to a larger value, when the control value calculated based on the speed difference is smaller than the predetermined value, the target rotation speed of the motor is substantially other than zero and the actual rotation speed is smaller than the predetermined rotation speed.

* * * * *